US008419605B2

(12) United States Patent
Keller

(10) Patent No.: US 8,419,605 B2
(45) Date of Patent: Apr. 16, 2013

(54) ARRANGEMENT FOR PRODUCING PAPER CUSHIONS

(75) Inventor: Sandro Keller, Dättlikon (CH)

(73) Assignee: Pack-Tiger GmbH, Dattlikon (CH)

( * ) Notice: Subject to any disclaimer, the term of this patent is extended or adjusted under 35 U.S.C. 154(b) by 1217 days.

(21) Appl. No.: 12/095,143

(22) PCT Filed: Nov. 14, 2006

(86) PCT No.: PCT/EP2006/010910

§ 371 (c)(1),
(2), (4) Date: Oct. 16, 2008

(87) PCT Pub. No.: WO2007/059880

PCT Pub. Date: May 31, 2007

(65) Prior Publication Data

US 2009/0226287 A1 Sep. 10, 2009

(30) Foreign Application Priority Data

Nov. 28, 2005 (DE) ..... 10 2005 056 640

(51) Int. Cl.
*B31B 1/00* (2006.01)

(52) U.S. Cl.
USPC ..... 493/464; 493/967; 414/332; 414/352; 414/661

(58) Field of Classification Search ..... 414/332, 414/345, 347, 349, 352, 431, 661, 789.7, 414/911; 493/464, 967
See application file for complete search history.

(56) References Cited

U.S. PATENT DOCUMENTS

| | | | | |
|---|---|---|---|---|
| 4,237,776 | A | 12/1980 | Ottaviano | |
| 4,557,716 | A | 12/1985 | Ottaviano | |
| 4,650,456 | A * | 3/1987 | Armington | 493/464 |
| 6,402,674 | B1 | 6/2002 | Simmons, Jr. et al. | |

FOREIGN PATENT DOCUMENTS

| | | |
|---|---|---|
| DE | 0700854 A2 | 1/1941 |
| DE | 1010912 | 6/1957 |
| DE | 2026813 | 12/1970 |
| DE | 2026862 B2 | 12/1970 |
| DE | 3713170 A1 | 11/1988 |
| DE | 4207199 A1 | 9/1992 |

(Continued)

OTHER PUBLICATIONS

German Search Report DE1020050566405 dated May 30, 2006.

*Primary Examiner* — Saul Rodriguez
*Assistant Examiner* — Willie Berry, Jr.
(74) *Attorney, Agent, or Firm* — Gifford, Krass, Sprinkle, Anderson & Citkowski, P.C.

(57) ABSTRACT

The present invention relates to an arrangement for producing paper cushions from a paper web which has been rolled up into a supply roll, the arrangement having a machine with a bearing arrangement for bearing the supply roll in a rotatable manner, and also having a device for forming the paper web and an arrangement for producing the paper cushions. The machine has coupling elements via which a transporting carriage provided with mating coupling elements can be coupled in a releasable manner to the machine, it being possible for a supply roll to be mounted on the transporting carriage such that, when the transporting carriage is coupled to the machine, the supply roll can be inserted into the bearing arrangement of the machine by way of a rolling and/or sliding movement.

20 Claims, 3 Drawing Sheets

FOREIGN PATENT DOCUMENTS

Figure 1:
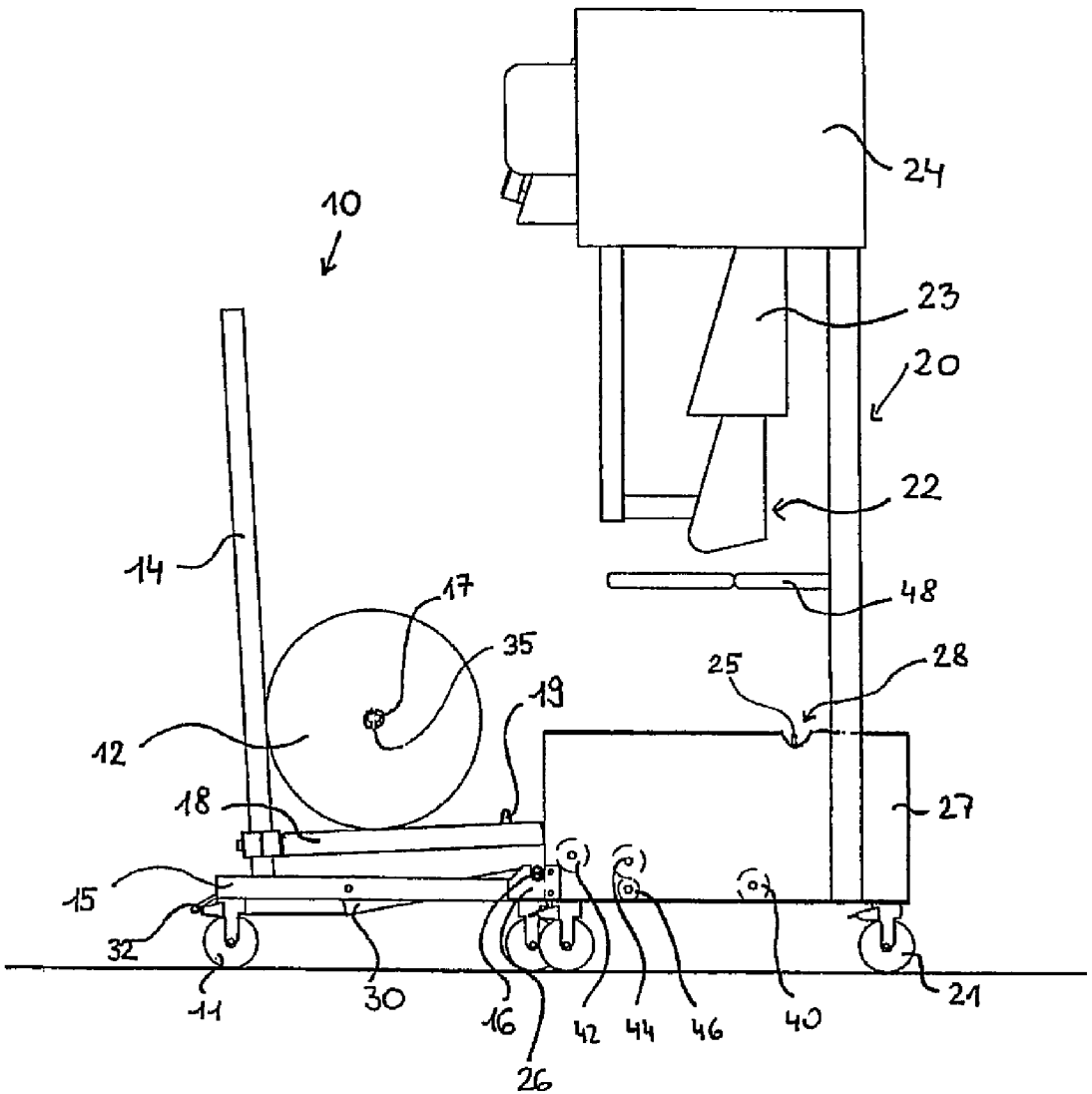

| | | | |
|---|---|---|---|
| DE | 4425079 | A1 | 1/1995 |
| DE | 19816441 | A1 | 11/1999 |
| DE | 19852978 | C2 | 5/2000 |
| EP | 0749925 | | 12/1996 |
| EP | 1027214 | B1 | 8/2000 |
| EP | 1323519 | | 7/2003 |
| FR | 2734777 | | 12/1996 |
| WO | WO-9910266 | | 3/1999 |
| WO | WO-0007808 | | 2/2000 |
| WO | WO-02079058 | A1 | 10/2002 |

* cited by examiner

ARRANGEMENT FOR PRODUCING PAPER CUSHIONS

CROSS REFERENCE TO RELATED APPLICATIONS

This application is the U.S. national phase of PCT/EP2006/010910 filed Nov. 14, 2006, which claims priority of German Patent Application No. 10 2005 056 640.5 filed Nov. 28, 2005.

The present invention relates to an apparatus for the manufacture of paper cushions from a paper web rolled up to form a dispensing roll, with the apparatus comprising a machine with a support apparatus for the rotatable support of the dispensing roll, a shaping device for the shaping of the paper web and an apparatus for the manufacture of the paper cushions. The present invention additionally relates to a transport trolley for such an apparatus.

An apparatus of this type is known from WO-A-00/07808. The apparatus manufactures a paper cushion having good damping properties and a low density from the paper web rolled off the dispensing roll, said paper cushion in particular being able to be used for the packing of impact-sensitive articles.

A disadvantage of the apparatus known from the prior art is that the paper dispensing roll has to be placed into the apparatus by hand in each case. The paper dispensing rolls used can be very heavy and in particular the lifting of the roll for the insertion thereof into the apparatus is thus associated with a considerable exertion of force and generally requires at least two persons.

It is therefore the object of the present invention, to provide an apparatus in accordance with the preamble of claim 1 in which the placement of the dispensing rolls is facilitated in comparison with the prior art.

This object is satisfied in that the machine of the apparatus has coupling elements via which a transport trolley provided with coupling elements matching them can be releasably coupled to the machine. A dispensing roll can be stored on the transport trolley such that it can be placed into the support apparatus of the machine by a rolling and/or sliding movement when the transport trolley is coupled to the machine.

The dispensing roll can be conveyed up to the machine of the apparatus almost without any force expenditure with the help of the transport trolley in accordance with the invention. An operator who would normally not be in a position to lift the dispensing roll and place it into the apparatus alone can couple the transport trolley to the machine of the device via the mutually matching coupling elements and can then place the dispensing roll into the support apparatus of the machine by a rolling and/or siding movement.

Subsequently, the operator can again decouple the transport trolley from the machine and use it again to transport a further dispensing roll to the machine.

In accordance with an advantageous embodiment of the apparatus, the support apparatus of the machine of the apparatus is formed by two bearing plates having two support recesses formed therein. Such a support apparatus is particularly simple in manufacture and in use. The bearing plates can additionally also simultaneously form lateral housing walls of the apparatus.

The transport trolley advantageously has a framework to which a platform is fastened in a vertically adjustable manner and/or pivotably around a horizontal axis. Such a platform can serve as a contact surface for the dispensing roll. The vertical adjustability is inter alia advantageous when one and the same transport trolley should be used in different apparatus since the level of the platform can then be adapted to the desired end level of the dispensing roll in the apparatus. In addition, the vertical adjustability of the platform can already facilitate the loading of the transport trolley with the dispensing rolls in every case. For example, the platform can, in a similar manner to a fork lift truck, first be upwardly adjusted to load the dispensing rolls from a higher shelf onto the transport trolley. The platform is then adjusted downwardly to the level required for the placement into the support apparatus for the placement of the dispensing rolls into the apparatus. In this connection, the platform can be disposed substantially in a horizontal plane in the simplest case and can only be moved up and down. It can, however, also additionally or alternatively be pivotable around a horizontal axis.

The platform is preferably fastened to the framework of the transport trolley in a self-supporting manner. This framework can, for example, consist of a simple vertically extending frame which is disposed at the side remote from the machine of the apparatus when the transport trolley is coupled to the machine. In this case, a vertical adjustability and/or a pivotability of the platform can be realized particularly simply.

The platform preferably has a blocking element at the side facing in the direction of the machine when the transport trolley is coupled to the machine, said blocking element being suitable to hold the dispensing roll on the platform. The blocking element can, for example, be a simple projection. However, a movable blocking element can also be provided which is adjustable between a blocking position in which it holds the dispensing roll on the platform and a release position for the transfer of the roll to the machine. For example, a pivotable or displaceable barrier, which can be latched in a blocking position, or a pluggable wall element are feasible.

In accordance with a preferred embodiment of the invention, a shaft which projects laterally over the roll and which can be inserted into the support apparatus at the machine of the apparatus extends through the middle of the dispensing roll. As already mentioned above, the support apparatus can, for example, be formed by two bearing plates having support recesses formed therein into which the shaft extending through the dispensing roll is inserted. To enable a security against rotation of the shaft, upwardly projecting pins, screws or similar can be provided in the recesses of the bearing plates and can be inserted into corresponding slit-shaped cut-outs in the shaft of the dispensing roll. Such cut-outs can be formed in a particularly simple manner when the shat is a hollow shaft which has corresponding slit-shaped material cut-outs at its ends projecting laterally over the dispensing roll. In another respect, such a shaft can also facilitate the handling of the dispensing roll even before its storage on the transport trolley and it can furthermore serve an operator as a handle to roll the dispensing roll into its end position on the transfer of the dispensing roll from the transport trolley to the support apparatus of the apparatus.

The coupling element of the transport trolley is preferably movable between a latching position and a release position, with it being latchable in its latching position to the coupling element provided at the machine of the apparatus. The two coupling elements can in particular be made such that the coupling element of the transport trolley has to be raised to bring about or release the latching to the coupling element at the machine of the apparatus.

In accordance with a preferred embodiment of the invention, the coupling element of the transport trolley includes a latch which an be hung into at least one recess which is formed at the machine in is latching position and which forms a coupling element of the machine. The coupling of the transport trolley to the machine can then be brought about or released again by an actuation of the latch, with the latch basically being able to have any conceivable shape.

The latch can, for example in accordance with an embodiment preferred due to its simplicity, be formed by a horizontally extending bar whose latching position is beneath its release position and which can be hung in its latching position into at least two recesses which are formed at the machine and which form coupling elements of the machine.

To couple the transport trolley to the machine of the apparatus, it is sufficient in this case to move it as close as possible to the apparatus, to raise the bar and then to move the transport trolley as close as possible to the machine until the bar is in its release position above the recesses. If the bar is now moved into its lower latching position, it slides into the recesses provided at the machine for this purpose, whereby the coupling of the transport trolley to the machine is established. In the lower latching position, the bar is held solely by gravity.

To release the latched connection, it is then conversely sufficient first to lift the bar and thus to move it into its release position and subsequently to move the transport trolley away from the machine of the apparatus.

Differently formed coupling elements can naturally also be used. A fixed, horizontally extending bar at the machine can thus, for example, also cooperate with gripping elements at the transport trolley movable between a latching position and a release position.

A chamfer is preferably formed at the machine which faces in the direction of the transport trolley and which, viewed from the transport trolley, is disposed in front of the recess for the latch. If a plurality of recesses are provided, such a chamfer is preferably disposed before every one of the same. Thanks to this chamfer, the latch, for example the bar described above, does not first have to be lifted into its release position by an operator so that the transport trolley can be moved to the machine. The chamfer rather provides that the latch is moved upwardly along the chamfer into its release position when the transport trolley is pushed to the machine. It is thus sufficient for the operator to move the transport trolley to the machine and to take care that the latch comes to lie on the chamfer formed at the machine. If he now moves the transport trolley further in the direction of the machine, the latch is raised automatically along the chamfer into its release position and finally slides into the recess disposed behind the chamfer.

The transport trolley preferably has an actuation pedal which is in operative connection with the coupling element of the transport trolley such that an actuation of the actuation pedal effects a movement of the coupling element from the latching position into the release position. With the horizontally extending bar described above as the coupling element, it can therefore be raised into its release position with the help of the actuation pedal so that an operator can simultaneously push the transport trolley into the desired position and can raise the bar. When the transport trolley is coupled to the machine, he can, for example, press down the actuation pedal so that the bar is lifted into its release position and can then move the transport trolley away from the machine.

A preferred embodiment of the invention will be described purely by way of example in the following with reference to an embodiment and to the enclosed Figures.

Figure 2:
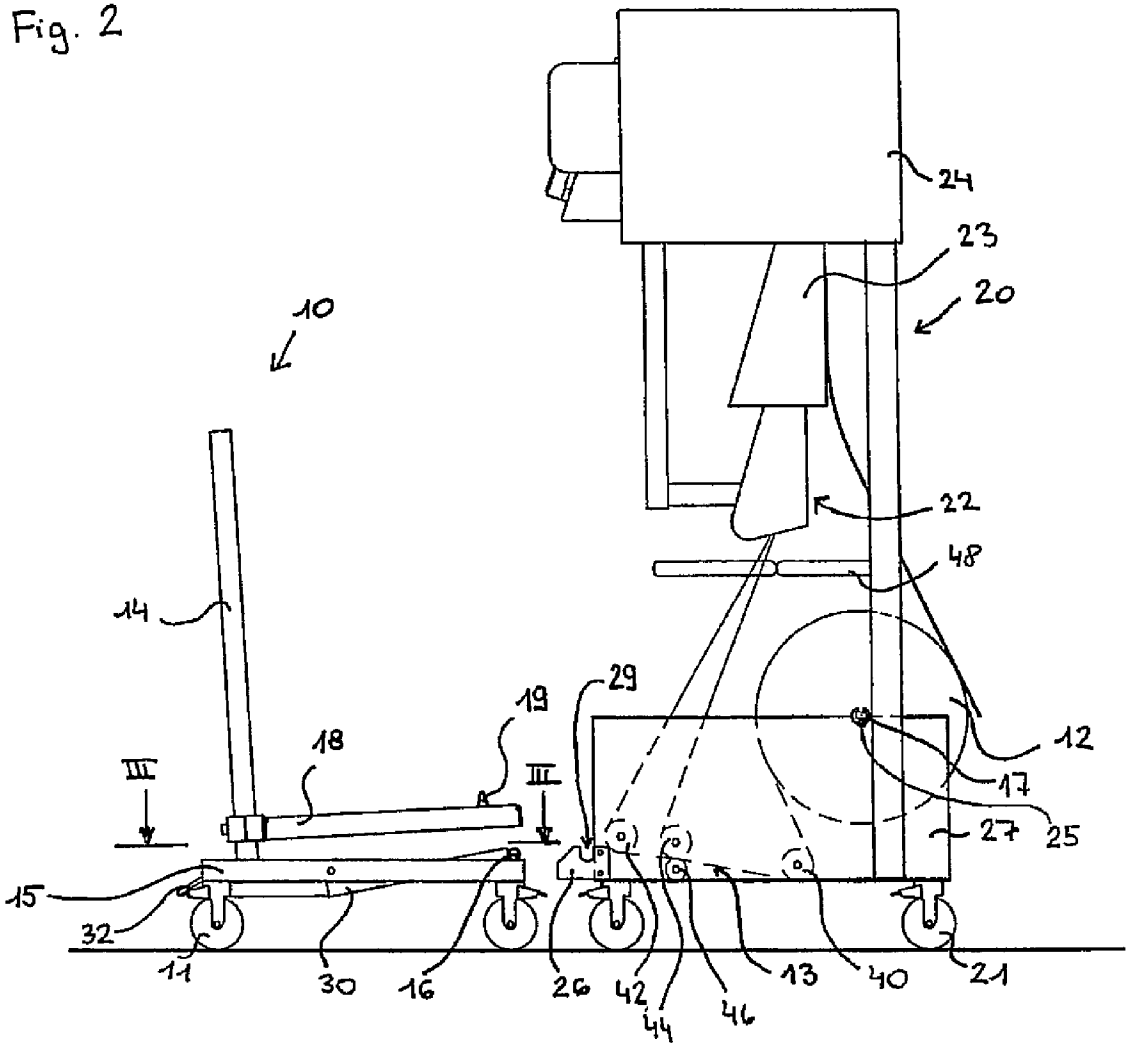
Figure 3:
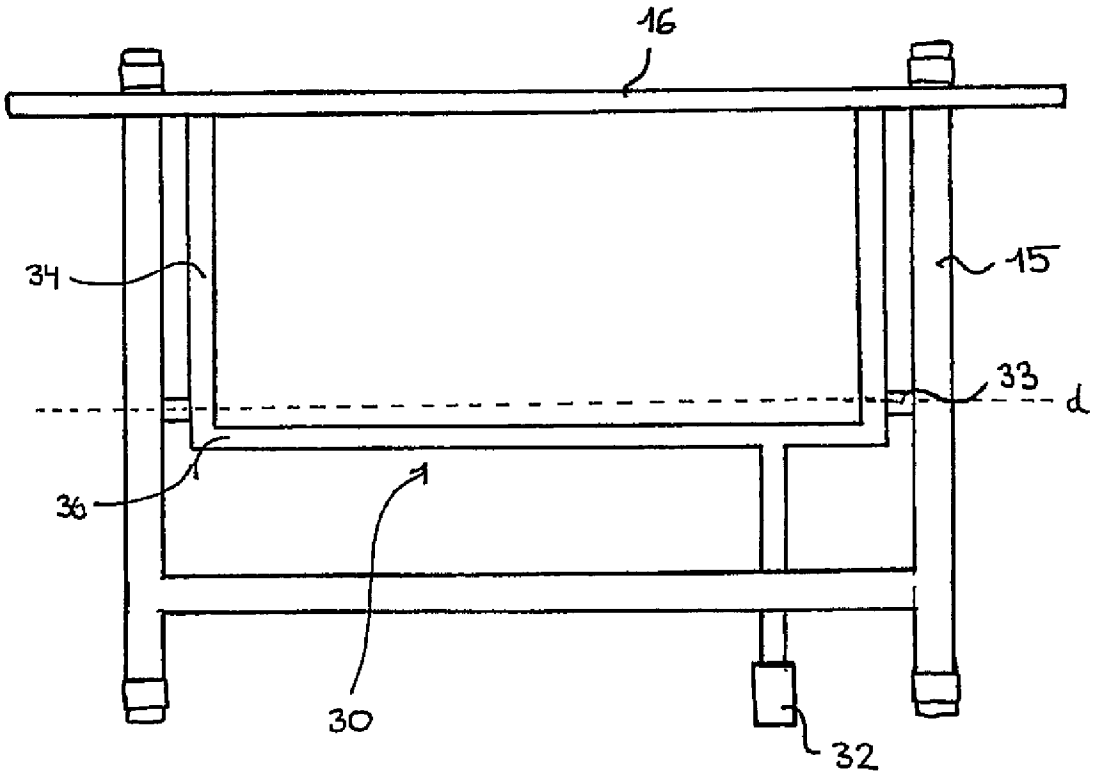

The Figures show in detail:

FIG. 1 a schematic representation of the apparatus before placement of the dispensing roll into the support apparatus;

FIG. 2 a schematic representation of the apparatus of FIG. 1 after insertion of the dispensing roll into the support apparatus;

FIG. 3 a section along the line III-III in FIG. 2.

FIG. 1 shows a schematic representation of an apparatus for the manufacture of paper cushions. The total apparatus consists of a transport trolley 10 shown at the left in FIG. 1 and a machine 20 shown at the right. A shaping device 22, with a shaping funnel 23, and an apparatus 24 for the actual manufacture of the paper cushions are attached to the machine 20. The shaping device 22 and the apparatus 24 are already known per se and are not the subject of the present invention so that they should not be described in more detail in the following.

The machine 20 stands on blockable rolls 21 so that it can be moved. As can be recognized in FIG. 2, a dispensing roll 12 can be inserted into a support apparatus which is formed by two bearing plates 27 which are each provided with support recesses 28 at their upper ends. A paper web 13 comprising at least two paper layers is rolled off from the dispensing roll 12 and is supplied to the shaping device 22 with the help of a system of a deflection roll 40, guide rolls 42, 44, 46 and a paper guide 48. The bearing plates 27 each form a lateral housing wall of the apparatus in the lower region of the machine 20 and protect the deflection and guide rolls 40, 42, 44, 46 disposed behind them. Since the latter are per se also not the subject of the present invention, they will not be looked at in any more detail in the following.

The support recesses 28 in the bearing plates 27 each have an upwardly open semi-circular cross-section so that a shaft 17 extending through the center of the dispensing roll 12 and projecting beyond it laterally can be rotatably supported in the support recesses 28. The upper ends of the bearing plates 27 terminate with a region which faces inwardly approximately at right angles and which is not shown in the Figures. A respective screw 25 is fastened to this region in each case at the level of the support recesses 28 such that it projects vertically upwardly into the recess 28. The shaft 17 is a hollow shaft and has two mutually oppositely disposed slit-shaped recesses 35 at each of its lateral ends projecting over the dispensing roll 12. The apparatus is shown in FIG. 2 in its operating state in which the shaft 17 of the dispensing roll 12 is hung into the support recesses 28. The screws 25 are seated in the slit-shaped cut-outs 35 of the shaft such that the shaft 17 cannot rotated in the bearing plates 27 on the rolling off of the paper from the dispensing roll. An unwanted lateral escape of the paper web can thereby be prevented.

A respective latch receiver in the form of a metal plate 26 which projects beyond the bearing plate 27 is arranged at the bottom at the side of the bearing plates 27 which is shown at the left in FIGS. 1 and 2 and which faces in the direction of the transport trolley 10 which will be described more precisely later. The metal plates 27, which are small in comparison with the bearing plate 26, each have a downwardly chamfered section at their front side facing in the direction of the transport trolley 10. A respective semi-round, upwardly open recess 29 is formed behind this chamfer in each of these metal plates 26, it is similar to the support recesses 28 and its function will be described more precisely later.

The transport trolley 10, which will be described more precisely in the following, is used for the placement of the dispensing roll 12 into the bearing plates 27 with their support recesses 28. The transport trolley 10 has a vertical framework 14 which stands on a horizontal base frame 15 to which rollers 11 are fastened at the bottom so that the transport trolley 10 can be moved just like the machine 20. A horizontal platform 18 is vertically adjustably fastened to the framework 14 and the dispensing roll 12 can be supported thereon as shown in FIG. 1. At its side facing the machine 20, the platform 18 has a blocking element 19 in the form of two upwardly projecting noses which present the dispensing roll 12 from rolling off the platform 18 in an unwanted manner. These noses can be resiliently supported and can be pivotable in the platform 18 to facilitate the loading of the transport trolley 10 with the dispensing roll 12 and also the transfer of the roll 12 from the transport trolley 10 to the machine 20. A rolling away of the dispensing roll 12 into the opposite direction to the machine 20 is prevented by the frame 14.

The apparatus is shown in FIG. 1 with a transport trolley 10 coupled to the machine 20. The part of the coupling mechanism attached to the transport trolley 10 can be recognized in the sectional representation of FIG. 3. The horizontal base frame 15 of the transport trolley 10 can be seen from above in FIG. 3 and it can be recognized that it is open at its front side which faces in the direction of the machine 20 and is upwardly disposed in FIG. 3. A U-shaped frame 30 is fastened to the two side parts of the base frame 15 which extend parallel to one another and of which one can also be seen in FIGS. 2 and 3. The U-shaped frame 30 is within the base frame 15 and its three sides 34, 36 extend parallel to the three sides of the base frame 15. In the state shown in the Figures, the base frame 15 and the U-shaped frame 30 are disposed substantially in one plane. The side limbs 34 of the U-shaped frame 30 and the side parts of the base frame 15 parallel thereto are connected to one another via rotation shafts 33. The inner U-shaped frame 30 is thus pivotably supported at the base frame 15 around a horizontally extending axis d.

A horizontal bar 16 which projects beyond the base frame 15 at the side and lies on it is fastened to the two side limbs 34 of the U-shaped frame 30 at the open side of the U. As is shown in FIG. 1, this bar can latch into the two above-mentioned recesses 29 which are formed in the metal plates 26 at the bearing plates 27 of the machine 20. An actuation pedal 32, by whose actuation the U-shaped frame 30 can be pivoted around its pivot axis d, is attached opposite the bar 16 at the transverse side 36 of the frame 30 connecting the two side limbs 34 of the U-shaped frame 32. If the actuation pedal 32 is depressed, the bar 16 in FIGS. 1 and 2 consequently moves upward. If the actuation pedal is released again, the bar 31 moves back down into the latching position shown in the Figures.

To couple the transport trolley 10 and the machine 20 to one another, an operator must therefore first move the transport trolley 10 as closely as possible to the machine 20 so that the bar 16 is raised into a release position by the chamfered metal plates 26 and finally latches into the recesses 29. The transport trolley 20 and the machine 10 are now firmly connected to one another.

In this coupled state shown in FIG. 1, the dispensing roll 12 can now be rolled over the blocking element 19 between the bearing plates 27 into its position shown in FIG. 2 until the axis 17 comes to lie in the support recesses 28.

Subsequently, the transport trolley 10 can again be decoupled from the machine 20 in that the actuation pedal 32 is depressed so that the bar 16 is again raised into its release position. The latch connection is thus released and the transport trolley 10 can again be moved away from the machine 20, for example to be loaded with a new dispensing roll.

| Reference numeral list | |
|---|---|
| 10 | transport trolley |
| 11 | roller |
| 12 | dispensing roll |
| 13 | paper web |
| 14 | framework |

-continued

| Reference numeral list | |
|---|---|
| 15 | base frame |
| 16 | bar |
| 17 | shaft |
| 18 | platform |
| 19 | blocking element |
| 20 | machine |
| 21 | roll |
| 22 | shaping device |
| 23 | shaping funnel |
| 24 | apparatus for the manufacture of the paper cushions |
| 25 | screw |
| 26 | metal plate |
| 27 | bearing plate |
| 28 | support recess |
| 29 | recess in metal plate 26 |
| 30 | U-shaped frame |
| 32 | actuation pedal |
| 33 | rotation shaft for U-shaped frame 30 |
| 34 | side limb of the U-shaped frame 30 |
| 35 | slit-shaped cut-out |
| 36 | transverse side of the U-shaped frame 30 |
| 40 | deflection roll |
| 42, 44, 46 | guide rolls |
| 48 | paper guide |
| d) | pivot axis |

The invention claimed is:

1. An apparatus for the manufacture of paper cushions from a paper web (13) rolled up to form a dispensing roll (12), wherein the apparatus has a machine (20) having a support apparatus (27, 28) for the rotatable support of the dispensing roll (12), a shaping device (22) for the shaping of the paper web (13) and an apparatus (24) for the manufacture of the paper cushions, wherein the machine (20) has at least one coupling element (29), the apparatus comprising a transport trolley (10) provided with at least one coupling element (16) matching so that said transport trolley is releasably coupled to the machine (20), with the dispensing roll (12) horizontally slidably supported on the transport trolley so that, with said transport trolley coupled to said machine by said coupling elements, said dispensing roll is transferred from said transport trolley to said support apparatus prior to unwinding by rolling and/or sliding said dispensing roll from said transport trolley (10) onto said support apparatus.

2. An apparatus in accordance with claim 1, characterized in that the support apparatus (27, 28) is formed by two bearing plates (27) having support recesses (28) formed therein, with the bearing plates (27) in particular also forming lateral housing walls of the apparatus.

3. An apparatus in accordance with claim 1, characterized in that the transport trolley (10) has a framework (14) at which a platform (18) is fastened in a vertically adjustable manner and/or in a manner pivotable around a horizontal axis.

4. An apparatus in accordance with claim 3, characterized in that the platform (18) is fastened to the framework (14) in a self-supporting manner.

5. An apparatus in accordance with claim 3, characterized in that the platform (18) has a blocking element (19) at the side facing in the direction of the machine (20) when the transport trolley (10) is coupled to the machine (20), said blocking element being suitable to hold the dispensing roll (12) on the platform (18).

6. An apparatus in accordance with claim 1, characterized in that a shaft (17) which projects laterally beyond the dispensing roll (12) and which can be inserted into the support apparatus (27, 28) at the machine (20) of the apparatus extends through the middle of the dispensing roll (12).

7. An apparatus in accordance with claim 6, characterized in that the shaft (17) projecting laterally beyond the dispensing roll (12) is a hollow shaft having slit-shaped cut-outs (35) at the lateral ends; and in that the support apparatus (27, 28) has upwardly projecting elements, in particular screws (25), for security against rotation at the machine (20) of the apparatus which are seated in the slit-shaped cut-outs (35) when the shaft (17) is inserted into the support apparatus (27, 28).

8. An apparatus in accordance with claim 1, characterized in that the coupling element (16) of the transport trolley (10) is movable between a latching position and a release position, with it being latchable in its latching position to the coupling element (29) provided at the machine (20) of the apparatus.

9. An apparatus in accordance with claim 8, characterized in that the coupling element of the transport trolley (10) includes a latch (16) which can be hung in its latching position into at least one recess (29) which is formed at the machine (20) and which forms a coupling element of the machine (20).

10. An apparatus in accordance with claim 9, characterized in that the latch is formed by a horizontally extending bar (16) whose latching position is beneath its release position and which can be hung in its latching position into at least two recesses (29) which are formed at the machine (20) and which form a coupling element of the machine (20).

11. An apparatus in accordance with claim 1, characterized in that the machine (20) has a latch mount (26) which is downwardly chamfered in the direction of the transport trolley (10) and in which a recess (29) for the reception of a latch (16) is formed at the top.

12. An apparatus in accordance with claim 1, characterized in that the transport trolley (10) has an actuation pedal (32) which is operatively connected to the coupling element (16) of the transport trolley (10) such that an actuation of the actuation pedal (32) effects a movement of the coupling element (16).

13. A transport trolley (10) for an apparatus for the manufacture of paper cushions from a paper web (13) rolled up to form a dispensing roll (12) comprising at least one coupling element (16) for the coupling of the transport trolley (10) to a machine (20) belonging to the apparatus, so that, with said transport trolley coupled to said machine by said coupling elements, said dispensing roll is transferred from said transport trolley to said support apparatus prior to unwinding by rolling and/or sliding said dispensing roll from said transport trolley (10) onto said support apparatus with the dispensing roll (12) being able to be supported on the transport trolley such that it can be placed into a support apparatus (27, 28) of the machine (20) by a rolling and/or sliding movement when the transport trolley (10) is coupled to the machine (20).

14. A transport trolley (10) in accordance with claim 13, characterized in that the trolley has a framework (14) to which a platform (18) is fastened in a vertically adjustable manner and/or in a manner pivotable around a horizontal axis.

15. A transport trolley (10) in accordance with claim 14, characterized in that the platform (18) is fastened to the framework (14) in a self-supporting manner.

16. A transport trolley (10) in accordance with claim 14, characterized in that the platform (18) has a blocking element (19) at the side facing in the direction of the machine (20) when the transport trolley (10) is coupled to the machine (20), said blocking element being suitable to hold the dispensing roll (12) on the platform (18).

17. A transport trolley (10) in accordance with claim 13, characterized in that the coupling element (16) of the transport trolley (10) is movable between a latching position and a release position.

18. A transport trolley (10) in accordance with claim 13, characterized in that the coupling element of the transport trolley (10) comprises a latch (16).

19. A transport trolley (10) in accordance with claim 18, characterized in that the latch is formed by a horizontally extending bar (16) whose latching position is beneath its release position.

20. A transport trolley (10) in accordance with claim 13, characterized in that it has an actuation pedal (32) which is operatively connected to the coupling element (16) of the transport trolley (10) such that an actuation of the actuation pedal (32) effects a movement of the coupling element (16).

* * * * *